United States Patent [19]

Aspelin et al.

[11] 3,971,369

[45] July 27, 1976

[54] FOLDED CUP-LIKE SURGICAL FACE MASK AND METHOD OF FORMING THE SAME

[75] Inventors: Gary B. Aspelin, Bridgewater; James T. Smith, Edison, both of N.J.

[73] Assignee: Johnson & Johnson, New Brunswick, N.J.

[22] Filed: June 23, 1975

[21] Appl. No.: 589,721

[52] U.S. Cl. ..... 128/146.2

[51] Int. Cl.[2] ..... A61M 16/00

[58] Field of Search ..... 128/141 R, 140 R, 139, 128/132 D, 146, 146.2, 146.3, 146.6, 146.7; 2/206

[56] References Cited

UNITED STATES PATENTS

| | | | |
|---|---|---|---|
| 1,523,884 | 1/1925 | Leduc | 128/139 |
| 2,634,724 | 4/1953 | Burns | 128/146 |
| 3,613,678 | 10/1971 | Mayhew | 128/146.2 |

FOREIGN PATENTS OR APPLICATIONS

| | | | |
|---|---|---|---|
| 892,262 | 3/1962 | United Kingdom | 128/146.2 |
| 967,455 | 8/1964 | United Kingdom | 128/146.2 |

*Primary Examiner*—Robert W. Michell
*Assistant Examiner*—Henry J. Recla

[57] ABSTRACT

A generally cup-shaped surgical facemask and a method for folding the body portion thereof, said body portion comprising a filtration medium, the method comprising (1) providing a blank of said filtration medium; (2) establishing a longitudinal fold line on said blank; (3) establishing first, second, and third transverse lines of demarcation on said blank, said second and third lines being on opposite sides of said first line; (4) establishing first and second points on one side edge and third and fourth points on the other side edge of the blank; (5) establishing angularly disposed fold lines which connect said points with said longitudinal fold line; (6) creasing said blank along said longitudinal fold line; and (7) moving said first and second points on one of said side edges and said third and fourth points on the other side edge to new positions lying between said second and third transverse lines of demarcation.

22 Claims, 21 Drawing Figures

FOLDED CUP-LIKE SURGICAL FACE MASK AND METHOD OF FORMING THE SAME

This invention relates to face masks and particularly to surgical face masks which are generally cup-shaped in form and which are intended, among other things, for the filtration of bacteria from exhaled breath.

The prior art has provided various kinds of face masks for hospital and surgical use. Face masks, and expecially surgical face masks, are designed to be worn over the nose and mouth and to filter bacteria from exhaled breath. One type of surgical face mask provided by the prior art is referred to as a "flat" face mask. Such masks, a typical example of which is disclosed in U.S. Pat. No. 3,613,678, have a body portion comprising a filtration medium one or both major surfaces of which are covered by an air pervious facing material. The sides, top and bottom edges of the body portion usually carry binding tapes which may be extended to provide tie strings for securing the mask over the nose and mouth during use. In some cases, the body portion of a flat face mask may be pleated. Whether pleated or unpleated, flat type face masks are known to fit quite closely, that is, most of the inner surface of the mask comes into contact with the face of the wearer. Thus, flat face masks are frequently found to be warm and uncomfortable during use; this is especially true when they are used, for example, in prolonged surgical procedures. In addition, the inner surfaces of the mask, due to contact with the mouth often becomes wet and abraded. When this happens, the abraded material from the inner surface may irritate the wearer, and the wetted portions of the mask may provide a path for the transmission of bacteria, thus interfering with one of the primary purposes of the mask.

Attempts have been made to overcome some of the problems involved with the flat type face masks by providing face masks which are generally cup-shaped in construction so that portions thereof are maintained away from the mouth and/or nose of the wearer when the mask is being used.

Thus, the term "cup-like face mask" as used herein refers to face masks having a three dimensional structure reminiscent of an ordinary cup and portions of which are designed to be free of direct contact with the mouth or nostrils of the wearer. In one type of cup-like face mask the body portion has a filtration medium containing thermoplastic fibers. The filtration medium is molded into its desired configuration and then treated with heat to permanently set it in its desired form. Such face masks are disclosed, e.g., in U.S. Pat. No. 3,220,409. Such a mask has a rather rigid structure and its outer periphery may not completely contact the face of the wearer. Thus, bacteria laden exhaled breath may leak around the edges of the mask without being filtered.

A surgical face mask in accordance with the present invention overcomes the above mentioned problems associated with the prior art. The mask is generally cup-shaped so that a more or less central portion thereof is maintained away from the mouth and nostrils of the wearer, thus eliminating the aforementioned problems with abrasion and wetting of the mask. Our mask, although cup-shaped, need not be molded and heat set to retain its shape. The edges of the body portion of our mask are not rigid and therefore conform readily to the contours of the wearer's face, thus avoiding the aforementioned difficulty with leakage around the edges of the mask.

Advantageously, our mask may be made from readily available, inexpensive materials which can be easily and quickly folded and secured together to provide the final desired configuration.

SUMMARY OF THE INVENTION

In accordance with the present invention there is provided an improved surgical face mask which greatly reduces the above-mentioned problems associated with prior art masks.

The improved mask of the invention comprises a body portion and means for securing the mask over the nose and mouth of the wearer. The mask also includes an elongated deformable member (referred to as a "nose clip") that conforms the upper portion of the mask, and holds it in place, over the bridge of the wearer's nose. The periphery of the mask has binding tapes which, if desired, may be extended to provide tie strings for securing the mask while being worn. Alternatively, an elastic band running from one side of the mask to the other may be provided in order to secure the mask in place.

The body portion of our new mask comprises a filtration medium for filtering bacteria and other matter from inhaled air or exhaled breath. The filtration medium may be any material, such as a woven or nonwoven fabric, a perforated film, or paper, known to those skilled in the art provided it may be readily creased and folded in the manner to be hereinafter disclosed. In a preferred embodiment the body portion comprises a fibrous filtration medium both major surfaces of which are covered by a lightweight, air pervious facing material.

The body portion of our mask has an upper part and a lower part with a generally central part therebetween. The central part of the body portion is folded backwardly about a vertical crease or fold line which substantially divides it in half, this fold or crease line, when the mask is worn, being more or less aligned with an imaginary vertical line passing through the center of the forehead, the nose, and the center of the mouth. The upper part of the body portion extends upwardly at an angle from the upper edge of the central part so that its upper edge contacts the bridge of the nose and the cheekbone area of the face. The lower part of the body portion extends downwardly and in the direction of the throat from the lower edge of the center part so as to provide coverage underneath the chin of the wearer.

A mask in accordance with the present invention thus overlies, but does not directly contact, the lips and mouth of the wearer. Inhaled and exhaled breath is filtered and problems with abrasion and wetting are largely eliminated inasmuch as the mask does not directly contact the wearer's lips and mouth.

In accordance with another aspect of the present invention, there is disclosed a method for folding the body portion to achieve the desired cup-shaped configuration. This method broadly comprises providing a blank of the material from which it is desired to make the body portion of the mask, establishing on the blank a number of fold lines defined by certain reference points and lines of demarcation, partially folding or creasing the blank around the fold lines so established, and securing the body portion in its thus folded, cup-like configuration.

Excess material at the periphery of the thus folded body portion may be trimmed or folded out of the way. Binding tapes are then attached along the edges of the body portion. A nose clip and means for securing the mask in place are attached to their appropriate places on the body portion and the mask is ready for use.

As used herein, and unless the context requires otherwise, the term "upper" refers to a structural element, or to a part of a structural element which, when the mask is worn, lies nearer the eyes of the wearer.

The term "lower", unless the context requires otherwise, refers to a structural element, or to a part of a structural element which, when the mask is worn, lies nearer the chin of the wearer.

BRIEF DESCRIPTION OF THE DRAWINGS

The aforementioned and other advantages of the present invention will become apparent upon reading the following detailed description and upon reference to the drawings in which.

DESCRIPTION OF THE PREFERRED EMBODIMENTS

Figure 1:
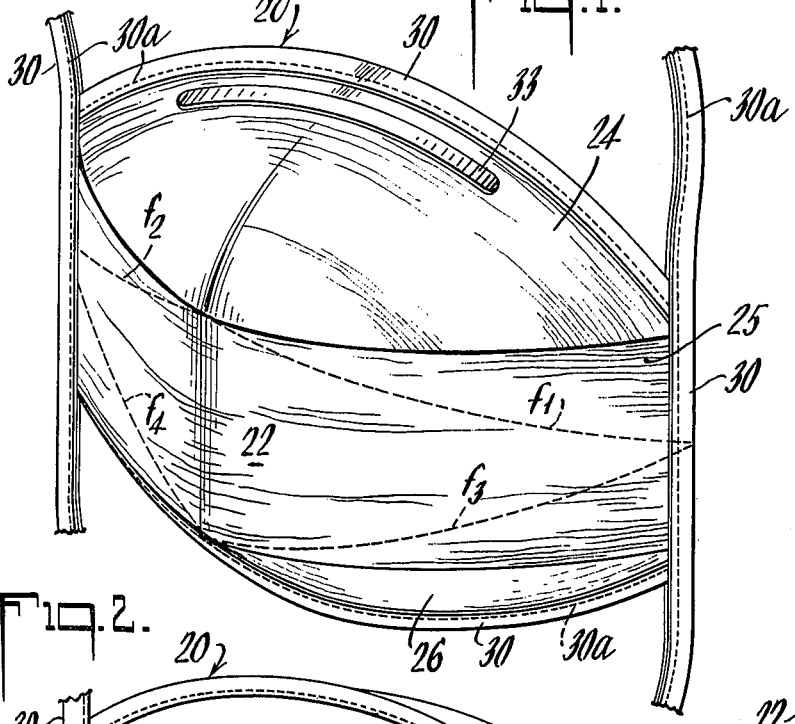
FIG. 1 is a front perspective view of one embodiment of the surgical face mask of the present invention.
Figure 4:
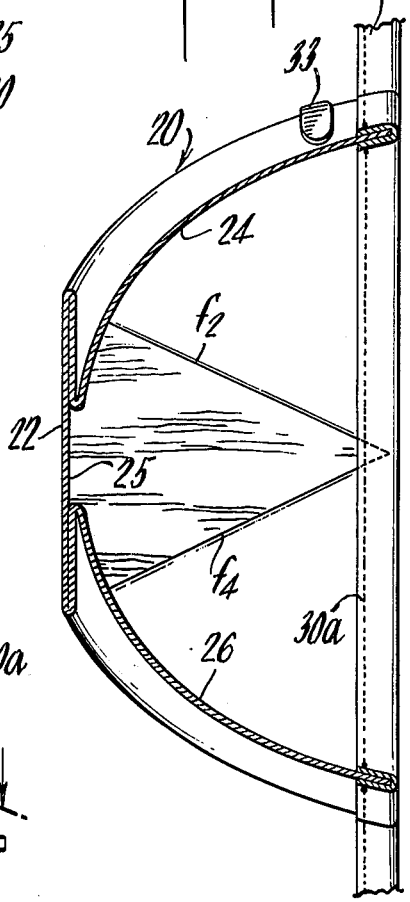
FIG. 4 is a cross-sectional view taken along line 4—4 of FIG. 3.
Figure 2:
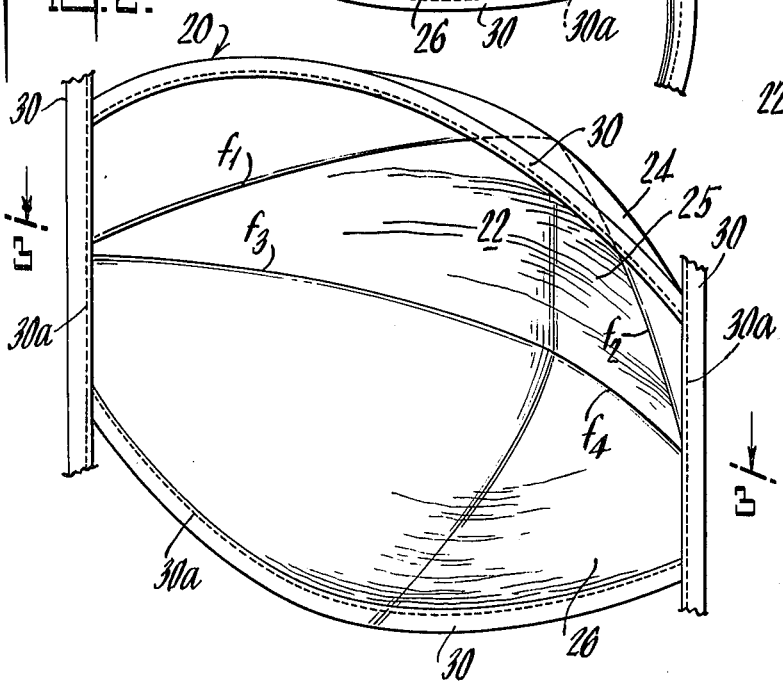
FIG. 2 is a rear perspective view of the mask of FIG. 1.
Figure 3:
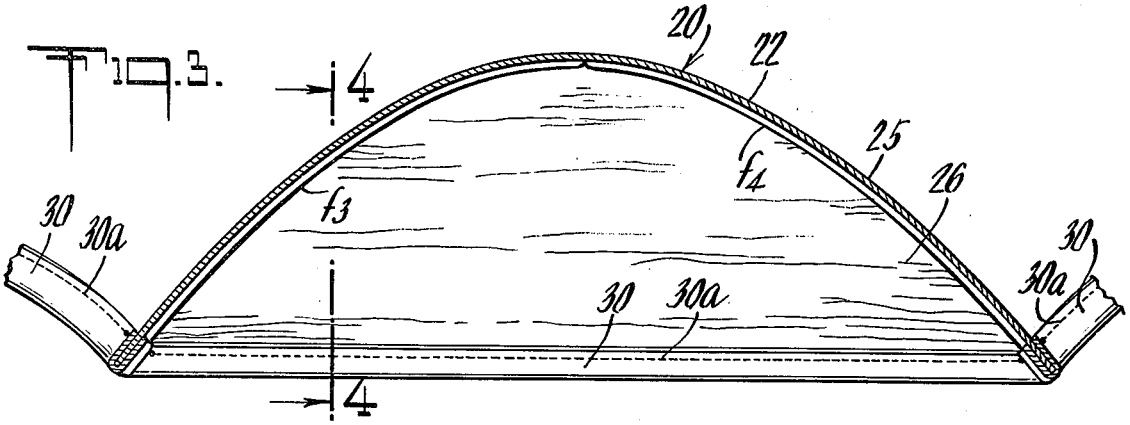
FIG. 3 is a cross-sectional view taken along line 3—3 of FIG. 2.

Referring now to FIGS. 1–6 of the drawings, there is illustrated one embodiment of the surgical face mask in accordance with the present invention. Face mask 20 comprises a body portion 22 having upper, lower and side binding tapes 30 secured to the periphery thereof. The bindings are preferably secured to the body portion by stitching 30a although other convenient means, such as an adhesive, may be used for this purpose if desired. The mask has a nose-clip 33 comprising a narrow strip of soft, deformable material such as, for example, aluminum. The ends of the side bindings are extended a suitable distance to provide means for holding the mask in place over the mouth and nose of the wearer during use.

Body portion 22 comprises an upper part 24, a lower part 26, and a generally central part 25 therebetween. Central part 25 is folded backwardly about a vertical crease or fold line 52 which divides it in half, this fold line, when the mask is worn, being in substantial alignment with an imaginary vertical line passing downwardly through the center of the wearer's forehead, his nose, and the center of his mouth (See FIG. 5).

Figure 5:
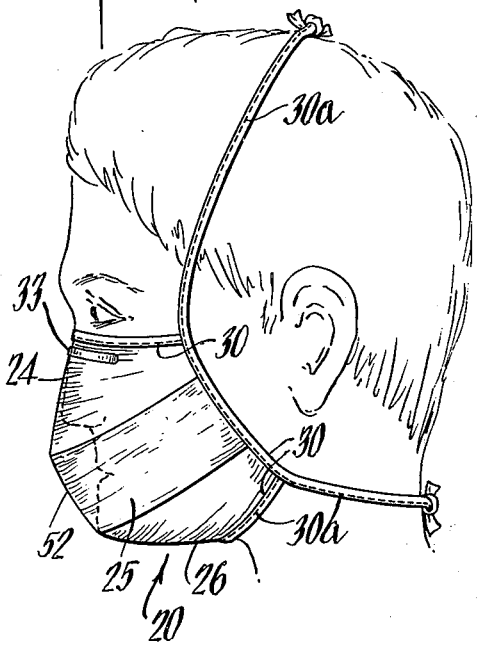
FIG. 5 is a side view of the surgical face mask of FIG. 1 in place and covering the mouth and nose of a wearer.
Figure 6:
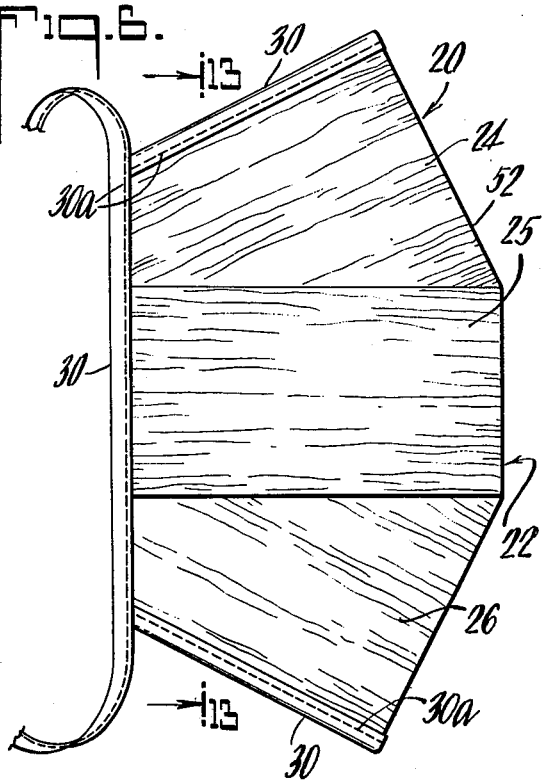
FIG. 6 is a side view, somewhat enlarged, of the surgical face mask of FIG. 1.

Upper part 24 of the body portion extends upwardly, and at an angle, from central part 25 so that its upper edge comes into contact with the bridge of the nose and the cheekbone area of the face when the mask is worn. As can be seen in FIG. 5, the inner surface of the upper part of the body portion in the region around fold line 52 comes into contact with the bridge of the wearer's nose but does not contact his nostrils.

Lower part 26 of the body portion extends downwardly, and in the direction of the wearer's throat from the central part of the body portion so as to provide coverage underneath the chin.

It will be recognized that body portion 22 necessarily comprises a filtration medium for filtering bacteria from breath exhaled by the wearer of the mask. Various suitable filtration media are well known in the art; among these are paper, perforated films woven fabrics, and bonded or unbonded nonwoven webs. Suitable fibers for use in nonwoven webs include fiberglass, rayon polypropylene, polyester, and the like.

Figure 18A:
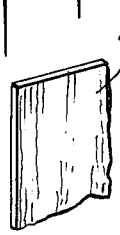
FIGS. 18*a*, 18*b*, and 18*c* are fragmentary perspective views of materials that are suitable for the body portion of the face mask.
Figure 18B:
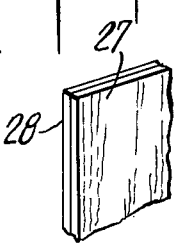
Figure 18C:
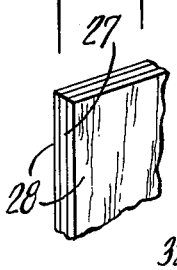

For the sake of clarity, the body portion is illustrated in the appended drawings (except for FIGS. 18*b* and 18*c*) as a single structural element, although it will be understood that, in fact, the body portion of a surgical face mask may comprise of one, two, or three structural elements. In certain circumstances, the body portion might consist solely of a filtration medium 27 (illustrated in fragmentary perspective view in FIG. 18*a*); this would be the case, for example, where the filtration medium is a piece of woven cloth or a bonded, continuous filament nonwoven web. The body portion may also comprise a filtration medium 27, one or both major surfaces of which are covered with a lightweight, air pervious facing material 28 such as gauze or a suitable nonwoven fabric (See FIGS. 18*b* and 18*c*).

Preferably, a surgical face mask in accordance with the present invention comprises two layers of a lightweight, air pervious nonwoven facing fabric with a fibrous filtration medium therebetween. The raw material and assembly costs of such a face mask are relatively low, so that the mask can be used once and then discarded.

METHODS FOR FORMING THE BODY PORTION OF THE FACE MASK

A preferred method for forming the body portion of the face mask of the present invention will now be described in conjunction with FIGS. 7 to 13 of the drawings. It will be recognized that the folding method described hereinafter is applicable to any of the above described body portions, and that, as used hereinafter in the specification the term body portion refers to and means a filtration medium alone, a filtration medium one of whose major surfaces is covered with a facing layer, or a filtration medium both of whose major surfaces are covered by facing fabrics.

Figure 7:
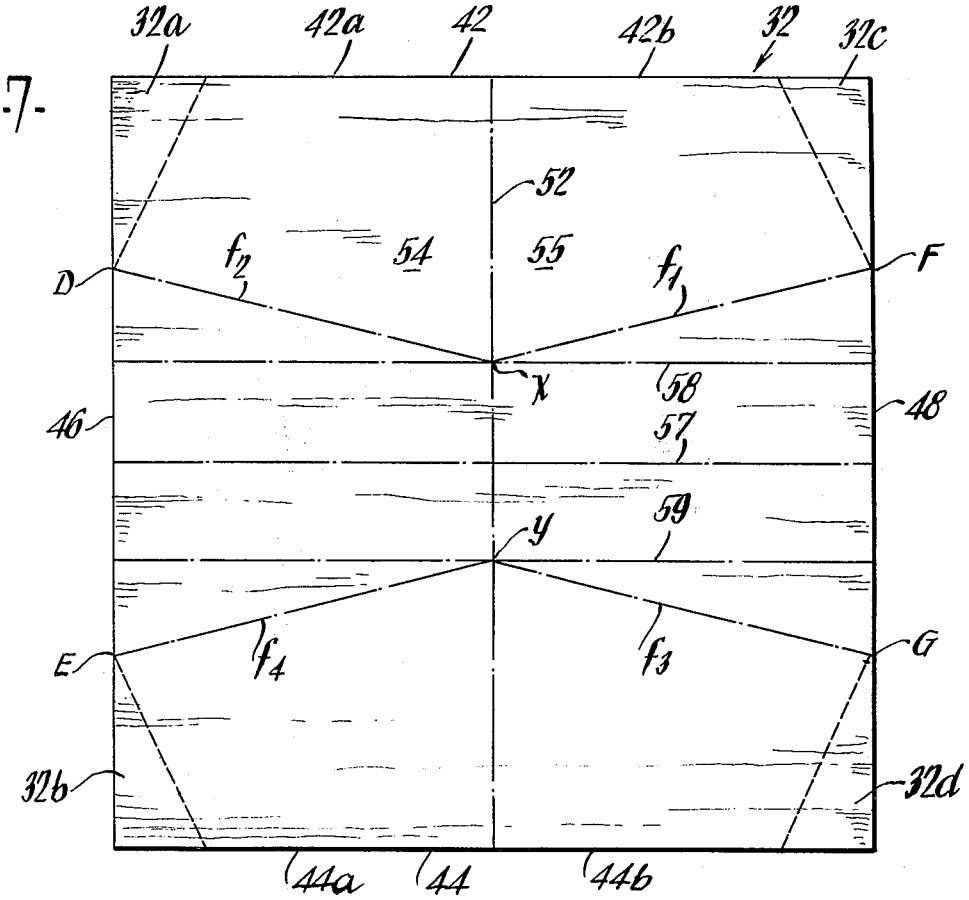
FIG. 7 is a plan view of a blank of suitable material, marked with certain lines and points, which may be folded to give the body portion of the surgical face mask of FIG. 1.

The body portion is formed by folding a blank 32 of the material from which it is desired to form said body portion. Referring to FIG. 7, blank 32 has a top edge 42, an opposed, generally parallel bottom edge 44, and a pair of generally parallel, opposed side edges 46, 48. As will be seen more clearly hereinafter, the top and bottom edges of blank 32 will comprise the upper and lower edges, and the side edges of the blank will comprise the side edges, of the completed face mask, after the body portion has been completely folded. It will be understood that the top edge of the face mask is that edge which runs generally across the bridge of the wearer's nose from one side of his face to the other; the bottom edge of the mask is that edge which runs more or less under the chin from one side of the face to the other. The side edges are those edges of the mask which run vertically when the mask is worn.

Blank 32 may vary in its dimensions depending on the size of the face mask that is desired and also depending on the relationship which is desired between the length of the side edges and the length of the top and bottom edges of the mask. It has been found in our work that a blank 7 ½ inches × 7 ½ inches may be folded to give a body portion which will provide a satisfactory fit in a very large number of cases. The blank has an upper surface 49 (the one seen by the viewer in FIG. 7) and a lower surface 50 (seen in part in FIG. 9).

Preparatory to folding, the blank is marked with certain fold lines and lines of demarcation as follows: Referring to FIG. 7, longitudinal fold line 52, running from top edge 52 to bottom edge 44 and dividing the blank into a first portion 54 and a second portion 55, is marked on the blank. In the preferred method, portions 54 and 55 of the blank are substantially equal in size. Longitudinal fold line 52 divides top edge 42 of the blank into two portions, **42*a* and 42*b*, and it divides the bottom edge of the blank into two portions, 44*a* and 44*b*. Thus the sides of portion 54 are defined by side edge 46 of the blank and longitudinal fold line 52; the top and bottom edges of portion 54 are defined by portions 42*a* and 44*a*, respectively. Similarly, the sides of portion 55 are defined by side edge 48 of the blank and longitudinal fold line 52 and the top and bottom edges of portion 55 are defined by portions 42*b* and 44*b***, respectively.

A first line of demarcation 57 running transversely, i.e., from side to side of the blank, is then established. In the preferred embodiment under discussion, line 57 is equidistant between, and runs substantially parallel to, the top and bottom edges of the blank.

A second line of demarcation 58 running transversely of the blank is established. Line 58 lies outside of first line of demarcation 57, that is, line 58 is located between line 57 and top edge 42 of the blank. In analogous fashion, a third line of demarcation 59 running transversely of the blank is established. Line 59 lies outside of first line of demarcation 57, that is, line 59 is disposed between line 57 and bottom edge 44 of the blank. It will be observed that second and third lines of demarcation 58 and 59 lie on opposite sides of first line of demarcation 57.

The next stage in the preparation of blank 32 for folding is to establish a set of points on each of side edges 46 and 48 of the blank. Point D is established on side edge 46 of the blank outwardly of second line of demarcation 58, that is, between line 58 and top edge 42 of the blank; point E is also established on side edge 46 of the blank outwardly of third line of demarcation 59, that is between line 59 and bottom edge 44 of the blank. A similar set of points is established on side edge 48 of the blank. Point F is established outwardly of line 58 and point G is established outside of line 59. In the preferred embodiment, a line joining point D with point F would be substantially parallel to, and lie between, line 58 and top edge 42. In other words, points D and F are spaced a substantially equal distance from line 58 along side edges 46 and 48, respectively. In the same manner, in the preferred embodiment, a line joining points E and G would be substantially parallel to, and lie between, line 59 and bottom edge 44 of the blank. Thus, points E and G are preferably spaced a substantially equal distance from line 59 along side edges 46 and 48, respectively.

The distance between point D and the point at which transverse line 58 intersects side edge 46, and the distance between point E and the point at which line 59 intersects side edge 46, cannot exceed the distance, along side edge 46 between lines 58 and 59. This same restriction also applies to the distance at which point F is placed from the point of intersection of line 58 and side edge 48 of the blank and to the distance at which point G is placed from the point of intersection of line 59 and side edge 48 of the blank. The distance between point F and the point at which transverse line 58 intersects side edge 48, and the distance between point G and the point at which line 59 intersects side edge 48, cannot exceed the distance, along side edge 48, between lines 58 and 59.

The preparation of the blank for folding is continued by establishing two points on longitudinal fold line 52. In the embodiment under discussion, first point *x* is established on line 52 at a location which coincides with the intersection of longitudinal fold line 52 and second line of demarcation 58. As will be explained later in this specification in connection with the description of a second embodiment of the present invention, point *x* may be placed outwardly of the intersection of lines 52 and 58, that is, between line 58 and top edge 42.

In the embodiment under discussion, second point y is established on longitudinal fold line 52 at a location which coincides with the intersection of line 52 and third line of demarcation 59. In the second embodiment to be discussed hereinafter, second point *y* may be placed outwardly of the intersection of lines 52 and 59, that is, between line 59 and bottom edge 44 of the blank.

Referring to FIG. 7, it will be observed that, in the embodiment under discussion, point *x* is located on line 52 at the point of intersection of that line with line 58; point *y* is located on line 52 at the point of intersection of lines 52 and 59.

The preparation of the blank is completed by estab-hing four angularly disposed fold or crease lines ereon. Two of these fold lines are established so as to in the two points D and F established on the sides of e blank and outwardly of second line of demarcation with point $x$ previously established on longitudinally tending line 52. The remaining two fold lines are tablished so as to join the two points E and G estab-hed on the sides of the blank and outwardly of third e of demarcation 59 with point y previously estab-hed on line 52. Thus, in the particular embodiment der discussion, fold line $f_1$ joins point F with point $x$; d line $f_2$ joins point D with point $x$; fold line $f_3$ joins int G with point $y$; and fold line $f_4$ joins point E with int $y$.

At this stage of the preparation, it will be noticed that ınk 32 is symmetrically marked with respect to both ıgitudinal fold line 52 and first transverse line of marcation 57.

Figure 8:
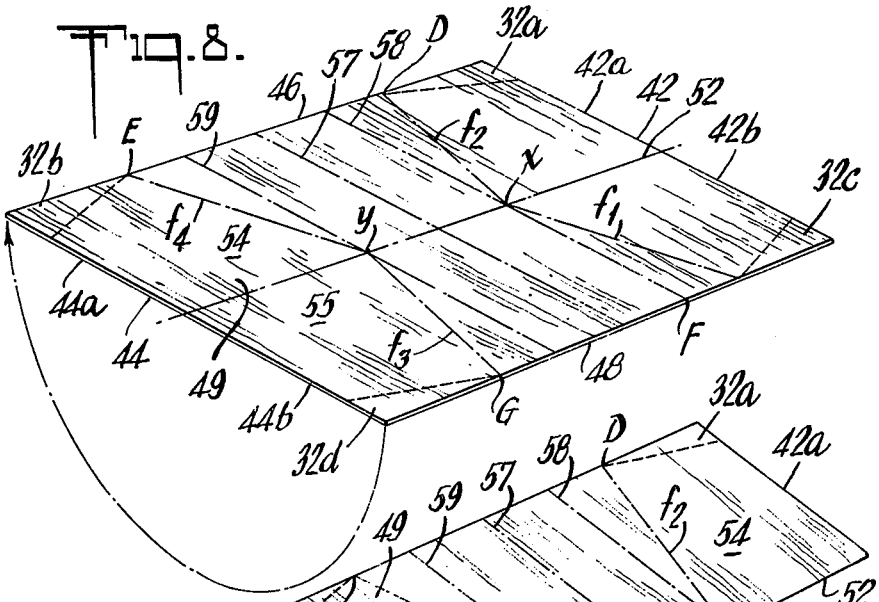
FIG. 8 is a perspective view of the blank of FIG. 7.
Figure 9:
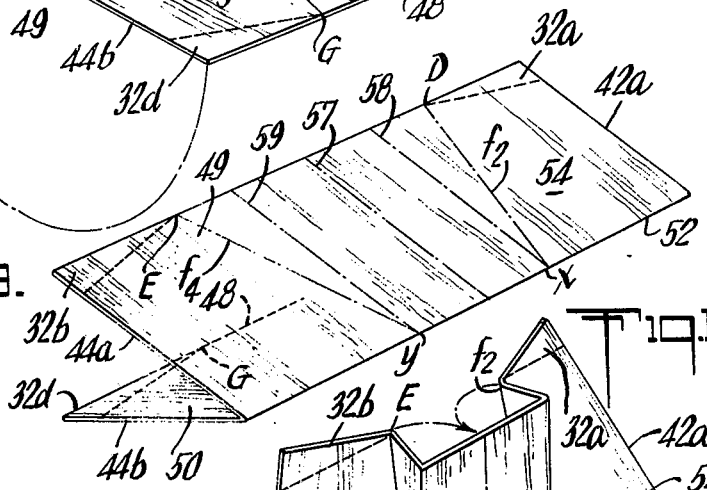
FIG. 9 is a perspective view showing the blank of FIG. 7 after the first step in the folding sequence has been completed.

Referring now to FIG. 8, the first step in the sequence converting the blank into cup shaped form is to ease the blank along longitudinal fold line 52. The ease is made in the manner indicated by the arrow in G. 8. As a result of this creasing, or partial folding, ɔund longitudinal fold line 52, the under surface of rtion 55 is brought toward the under surface of por-n 54 (see FIG. 9). If the under surfaces of portions and 55 were to be brought into face to face contact, d line $f_2$ would be substantially aligned with, and erlie, fold line $f_1$, and fold line $f_4$ would be substan-lly aligned with, and overlie, fold line $f_3$.

Figure 10:
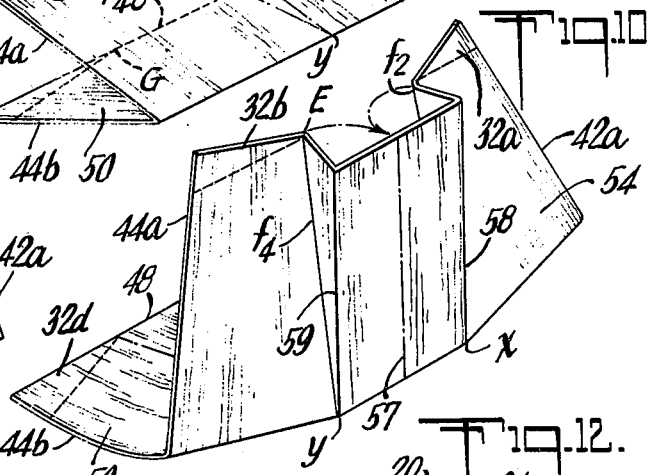
FIG. 10 is a perspective view showing the blank during an intermediate stage of folding.
Figure 11A:
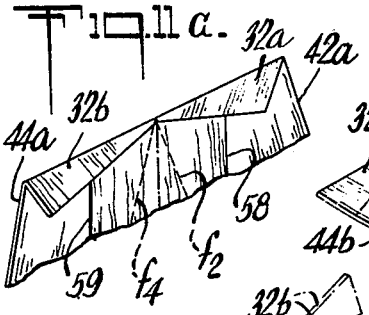
FIG. 11*a* is a fragmentary view showing how excess material in the folded blank may be folded out of the way.
Figure 11:
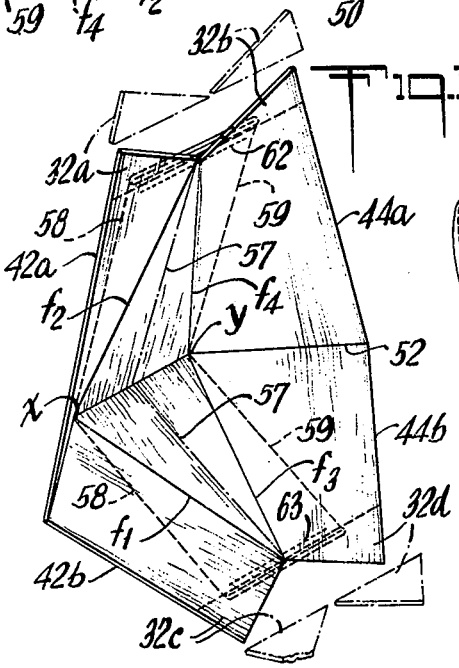
FIG. 11 is a perspective view of the blank after it has been folded into its cup-shaped form.

The next step in the folding sequence involves folding blank so that points D and E on side edge 46 of the ınk are moved to positions between second line of marcation 58 and third line of demarcation 59. This y be accomplished in two ways. In accordance with preferred way illustrated in FIG. 10, blank 32 is erse folded around that portion of line 58 lying ween side edge 46 and longitudinal fold line 52 and ɔund that portion of line 59 lying between side edge and line 52. Thus, in making the above-mentioned erse folds, a portion of the lower surface of the nk is turned toward another portion of its lower face. Also, as seen in FIG. 10, the moving of points ınd E to their new positions involves forward folding blank around lines $f_2$ and $f_4$. These folds, being ward folds, are characterized in that a portion of the ɔer surface of the blank is turned toward another tion of the upper surface of the blank.

t will be recognized that, in the embodiment under cussion, the reverse folding around lines 58 and 59 l the forward folding around lines $f_2$ and $f_4$ bring nts D and E into contact with the under surface 50 he blank. After points D and E have been moved, in manner indicated by the arrows in FIG. 10, to their positions between lines 58 and 59, the portion of edge 46 between point D and line 58 contacts that tion of side edge 46 lying between lines 58 and 57; l the portion of side edge 46 between point E and 59 contacts that portion of side edge 58 between s 59 and 57. Thus, in this particular embodiment, above-described folding sequence brings points D E into abutting relationship at the point where first ısverse line 57 intersects side edge 46 (see upper tion of FIG. 11).

fter the above steps have been completed, the por-ı of the blank which has just been folded should be ıred, e.g., with a few stitches or with a few drops of a suitable adhesive, at the place indicated by dotted line 62 in FIG. 11. This allows the shape of the blank to be retained during the remainder of the folding procedure.

The conversion of blank 32 to its desired cup shaped configuration is completed by folding the blank so that points F and G on side edge 48 are moved to positions which lie between second line of demarcation 58 and third line of demarcation 59. This is done in the same manner as that already described above in connection with points D and E. Thus, in moving point F to its new position, the blank is reverse folded around that portion of line 58 lying between side edge 48 and longitudinal fold line 52, and forward folded around fold line $f_1$. Point G is moved to its new position by reverse folding the blank around that portion of line 59 lying between longitudinal line 52 and side edge 48 and by forward folding around fold line $f_3$. At this point, the side of the blank which has just been folded is secured in position by applying stitching or adhesive in the areas indicated by dotted line 63 in FIG. 11.

Figure 12:
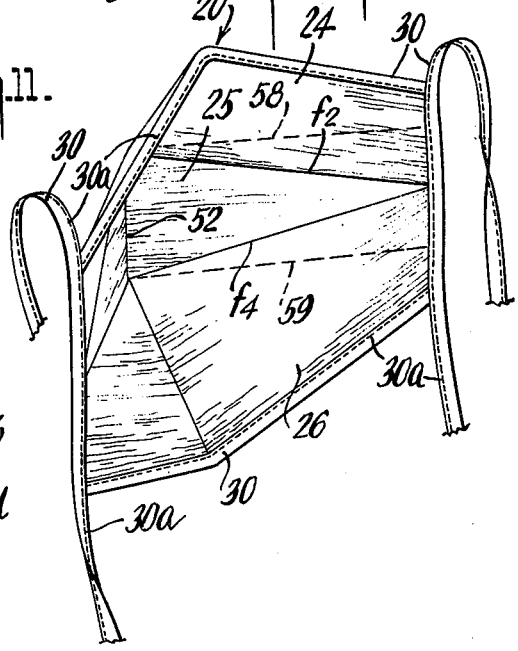
FIG. 12 is a rear perspective of the finished face mask after the binding tapes have been sewn on and the nose clip applied.
Figure 13:
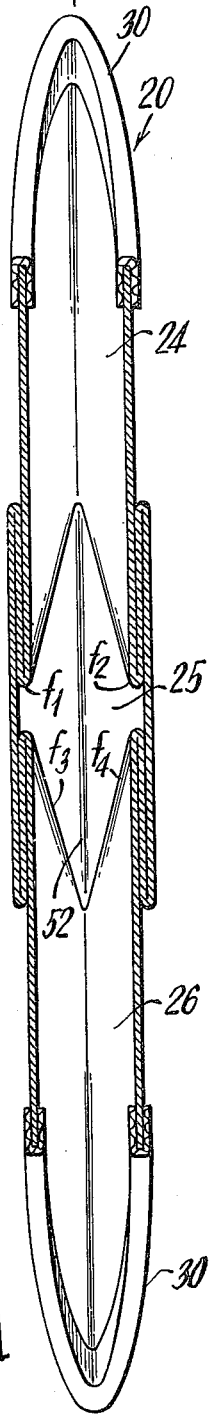
FIG. 13 is a cross-sectional view taken along lines 13—13 of FIG. 6.
Figure 14:
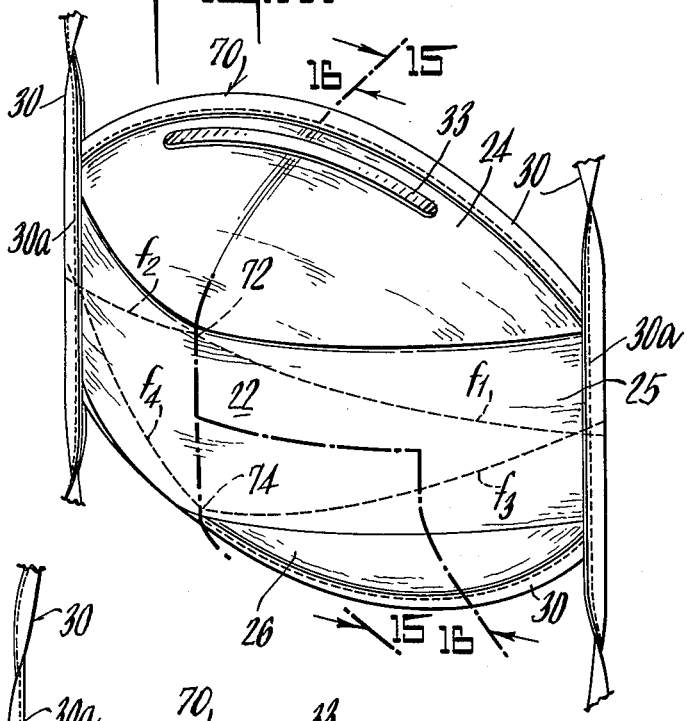
FIG. 14 is a front perspective view of a second embodiment of the surgical face mask of the present invention.

After the above folding steps have been completed, the blank will have assumed the cup shape form shown in FIG. 11. Triangular portions **32*a*, 32*b*, 32*c*, and 32*d* of blank 32 are not needed. These triangular portions are preferably cut away (indicated by the phantom portions of FIG. 11) but, if desired, they may be folded out of the way over the side edges of the folded blank as illustrated in FIG. 11*a*. When the folding and timming have been completed as described, bindings, may be applied in the usual way along the top and bottom edges of the mask. The side bindings, extended in length to provide tie strings, and the nose clip, if desired, are then applied and the face mask is completed. Several of the finished face masks may be packaged by stacking or "nesting" one inside the other. FIG. 12** is a perspective view showing the inner surface of the completed face mask. The side bindings have been extended to provide tie strings.

It will be understood that triangular portion **32*a*, 32*b*, 32*c*, and 32*d*, since these are not needed in the final mask, may be cut away from blank 32 prior to the start of the folding sequence. Also, while the folding of the blank has been described as involving reverse folds around lines 58 and 59 and forward folds around fold lines $f_1, f_2, f_3$, and $f_4$, the cup shaped configuration can be achieved by forward folding around lines 58 and 59 and reverse folding around fold lines $f_1, f_2, f_3$, and $f_4$. In the latter case, the folds around fold lines $f_1, f_2, f_3$, and $f_4$ would lie on upper surface 49 of the blank couter surface of the finished mask), whereas in the former case, these folds would be next to lower surface 50** of the blank (inner surface of the finished mask).

With regard to the trimming of the periphery of the blank after folding, it will be understood that this may be done in a variety of ways. Thus, for example, while FIGS. 11 and **11*a*** shows the side edges of the folded blank as being straight after the unneeded triangular portions are cut or folded out of the way, the folded blank can also be trimmed so that its periphery is given a rounded contour.

Referring now to FIGS. 14–17, there is shown another embodiment of the face mask of the present invention.

Face mask 70 is quite similar to face mask 20 described previously and comprises a generally cup-shaped body portion 22, a nose clip 33, and binding tapes 30 around the periphery thereof. The side bindings are extended to provide means for securing the mask over the nose and mouth of the wearer. The body portion may comprise any suitable filtration medium of the kind discussed earlier herein in conjunction with the description of face mask 20. A facing fabric may be used on one or both major surfaces of the filtration medium.

Figure 16:
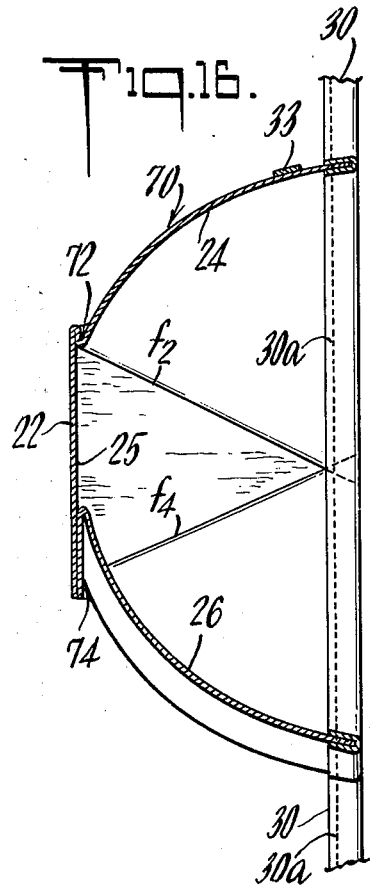
FIG. 16 is a view, partially in cross-section, taken along line 16—16 of FIG. 14.
Figure 15:
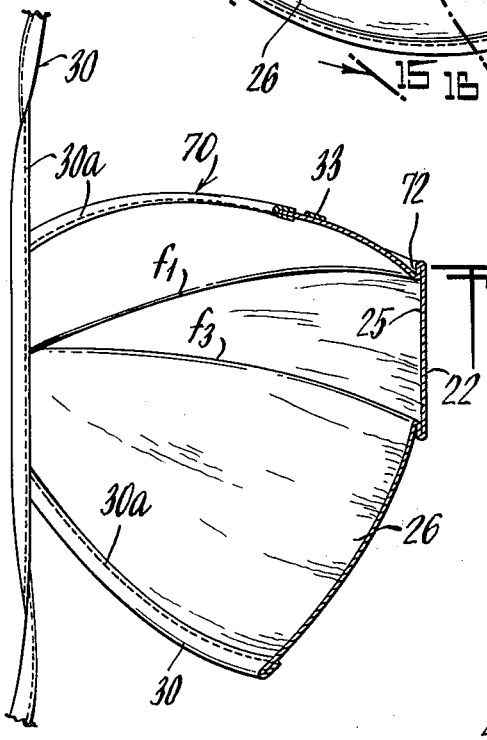
FIG. 15 is a view, partially in cross-section, taken along line 15—15 of FIG. 14.

As was the case with face mask 20, the body portion comprises an upper portion 24, a generally central portion 25, and a lower portion 26. As best seen in FIGS. 15 and 16, there is a tucked portion or pleat 72 in the body portion. This pleat is in longitudinal fold line 52 where the upper part of the body portion meets the central part of the body portion. There is a similar tucked portion or pleat 74, also in longitudinal fold line 52 where the central part of the body portion joins the lower part of the body portion.

The body portion of face mask 70 can be folded from a blank similar to the one from which the body portion of face mask 20 was folded.

Blank 75 has a top edge 42, a bottom edge 44, and a pair of side edges 46 and 48. The blank has an upper surface 49 (the major surface exposed to view in FIG. 17) and a lower surface (the major surface which is not seen in FIG. 16). Longitudinal fold line 52 divides blank 75 into first portion 54 and second portion 55. Line 52 divides top edge 42 into portions 42*a* and 42*b* and it divides top edge 44 into portions 44*a* and 44*b*. Blank 75 has a first transverse line of demarcation 57, a second transverse line of demarcation 58, and third transverse line of demarcation 59 as was the case with blank 32. Points D, E, F, and G are established on blank 75 in the same way, and under the same limitations, as they were established for blank 32 as set forth earlier herein.

Figure 17:
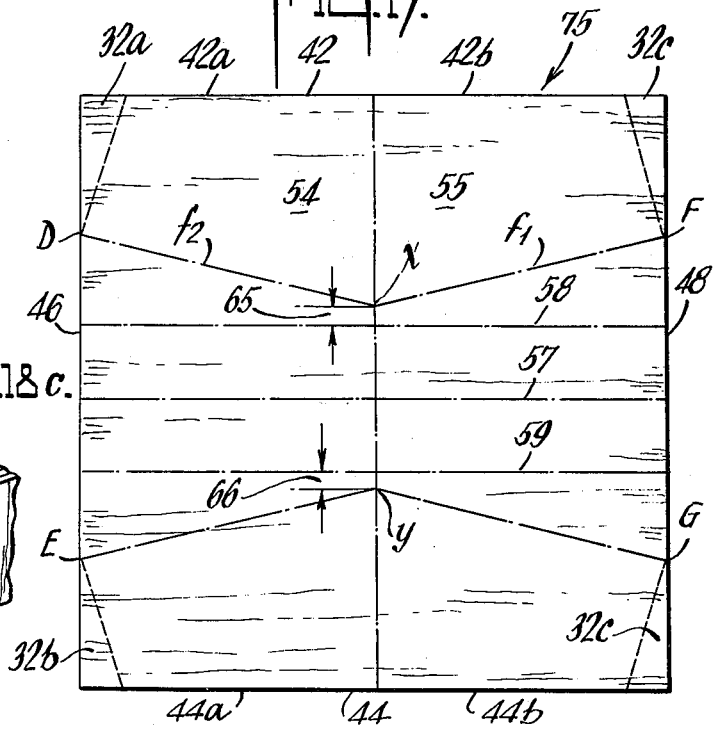
FIG. 17 is a plan view of a blank of suitable material, marked with certain fold lines and points, which may be folded to give the body portion of the face mask of FIG. 14.

Referring to FIG. 17, it will be noticed that point *x* is marked on longitudinal line 52 outwardly of the intersection of line 52 with line 58, that is, point *x* is displaced a distance 65 from the intersection of line 52 and line 58 toward top edge 42. Similarly, point *y* is marked on longitudinal line 52 outwardly of the intersection of line 52 with line 59, that is, point y is displaced a distance 66 from the intersection of line 52 and line 59 toward bottom edge 44. In this embodiment, point *x* is placed outwardly of line 58 a distance 65 that is equal to about 20% of the distance between lines 57 and 58. Similarly, point *y* is placed outwardly of line 59 a distance 66 and is equal to about 20% of the distance between lines 57 and 59. Since, in the embodiment under discussion, lines 58 and 59 are equally spaced from line 57, it will be understood that distances 65 and 66 are equal. As was the case with the earlier embodiment, neither point *x* nor point *y* may be located on line 52 in the area between transverse lines 58 and 59. The location of points *x* and *y* on line 52 may be varied to some extent. As was seen earlier in connection with the description of face mask 20, point *x* may coincide with the point at which lines 52 and 58 intersect, and point *y* may be located at the point at which lines 52 and 59 intersect.

Where point *x* does not coincide with the intersection of line 52 with line 58 distance 65 is preferably limited so that it does not exceed about 75% of the distance along side edge 48, between the intersection of line 58 with side edge 48 and the intersection of line 57 with side edge 48. Where point *y* does not coincide with the intersection of line 52 with line 59, distance 66 is likewise preferably limited so that it does not exceed about 75% of the distance, along side edge 48, between the intersection of line 59 with side edge 48 and the intersection of line 57 with side edge 48. As distances 65 and 66 are increased beyond about this 75% limitation (assuming the locations of points F and G on side edge 48 are not changed), the folded blank becomes increasingly "flatter," that is, it starts to lose its three-dimensional, cup-shape structure, and the seal between the edges of the final mask and the wearer's face becomes less effective. Even more preferably, we have found that distance 65 should be limited to about 50% of the distance (along side edge 48) between the intersection of line 57 with side edge 48 and the intersection of line 58 with side edge 48; distance 66 should likewise be limited to about 50% of the distance between the intersection of line 57 with side edge 48 and the intersection of line 59 with side edge 48. Most preferably, distance 65 should be not more than about 25% of the distance between the intersection of line 57 with side edge 48 and the intersection of line 58 with side edge 48; most preferably, distance 66 should be not more than about 25% of the distance between the intersection of line 57 with side edge 48 and the intersection of line 59 with side edge 48. When placement of points *x* and *y* is limited to the last mentioned value, the resulting face masks have excellent three dimensional characteristics so that the inner surface of the mask does not come into contact with the mouth and lips of the wearer. At the same time, positive contact is provided between the edges of the mask and the face of the wearer, thus insuring that exhaled breath does not escape without being filtered.

While not wishing to be bound by any particular dimensions, we have found that a blank of the following dimensions can be folded in accordance with the present invention to provide a finished surgical face mask that satisfactorily fits a large number of users: size of blank, 7.5 inches by 7.5 inches; longitudinal line 52 placed equidistant from the side edges of the blank; first transverse line of demarcation 57 placed equidistant from the top and bottom edges of the blank; second and third transverse lines of demarcation 58 and 59 placed about one inch on either side of line 57; points *x* and *y* placed about 0.2 inches outwardly of lines 58 and 59, respectively; points D and F about 1 ¼ inches outwardly of line 58; and points E and G about 1 ¼ inches outwardly of line 59.

The folding sequence used to convert blank 75 to its desired cup-shaped form is nearly identical with the folding sequence described earlier herein for blank 32. In order to provide pleats 72 and 74 in the finally folded body portion, it is necessary to fold the blank shown in FIG. 17 so that points *x* and *y* are brought from their positions outside of lines 58 and 59, respectively, to new positions inside of these lines. Thus point *x* will be brought to a new position on longitudinal fold line 52 which lies between lines 57 and 58; and point *y* will be brought to a new position on line 52 which lies between line 57 and 59. The folding of blank 75 is then completed by performing the folding sequence already described for blank 32.

It will be observed that point *x* is brought to its new position by folding, or "pivoting," that portion of line 52 defined by distance 65 around the point of intersection of lines 58 and 52 (in a direction toward the center of the blank). Point *y* is moved to its new position in analogous fashion. The relationship between points *x* and *y* and line 52, after pleats 72 and 74 have been formed, is illustrated in FIG. 15. Notice that points $x$ and $y$ now lie in contact with line 52 on the inner surface of the central portion of the blank. When the body portion is pleated along line 52 and, as is preferred, the folds along lines $f_1, f_2, f_3$, and $f_4$ are forward folds, then points $x$ and $y$ contact the inner surface of blank 75 when the folding is completed. When the body portion is pleated along line 52, and the folds along lines $f_1, f_2$, $f_3$ and $f_4$ are reverse folds, then points $x$ and $y$ contact the outer surface of blank 75.

When pleats 72 and 74 are provided in the body portion as just described, the finished face mask has a degree of "give" in its structure which allows the mask to be more easily adjusted to suit the needs of individual wearers.

Those skilled in the art will recognize that many variations can be made in the embodiments described herein without departing from the spirit and scope of the present invention. The size of the finished mask may be varied by changing the dimensions of the blank. The relative sizes of the upper, lower and central portions of the body of the mask may be varied by varying the spacing between transverse lines 58 and 59. While longitudinal line 52 should preferably be placed midway between the sides of the blank (so that the mask will be symmetrical from side to side), this placement of line 52 is not critical to the present invention and can be varied if the circumstances should warrant. The top and bottom bindings, rather than the side bindings, could be extended to form the tie strings. Alternative means, e.g., a single elastic string whose ends are secured to the sides of the mask to form a loop, could be used for holding the mask in place. The bindings themselves could be made from strips of nonwoven fabric instead of from woven fabric.

What is claimed is:

1. A method for forming the body portion of a generally cup-like facemask comprising a body portion and means for holding the mask over the nose and mouth of a wearer, said body portion comprising a filtration medium, said method comprising:

1. providing a blank of said filtration medium, said blank having top and bottom edges and a pair of opposed side edges;
2. establishing on said blank a longitudinal fold line running from top to bottom thereof;
3. establishing a first transverse line of demarcation on said blank, said first line being substantially parallel to the top and bottom edges of said blank and extending from side to side thereof;
4. establishing a second transverse line of demarcation on said blank, said second transverse line extending from side to side of said blank, said second line being between, and generally parallel to, said first transverse line and one of said top and bottom edges of the blank;
2. establishing a third transverse line of demarcation on said blank, said third line extending from side to side of said blank, said third line being between, and generally parallel to, said first transverse line and the other of said top and bottom edges of the blank;
6. establishing first and second points on one of said side edges of said blank, said first point being between the point at which said second transverse line of demarcation meets said one of said side edges, and said one of said top and bottom edges, said second point being between the point at which said third transverse line of demarcation meets said one of said side edges and said other of said top and bottom edges, the distance between said first point and said second transverse line of demarcation, and the distance between said second point and said third transverse line of demarcation being not greater than the distance between said second line of demarcation and said third line of demarcation.
7. establishing third and fourth points on the other of said side edges of said blank, said third point being between the point at which said second transverse line of demarcation meets said other of said side edges and said one of said top and bottom edges, said fourth point being between the point at which said third transverse line of demarcation meets said other of said side edges and said other of said top and bottom edges, the distance between said third point and said second transverse line of demarcation, and the distance between said fourth point and said third transverse line of demarcation being not greater than the distance between said second line of demarcation and said third line of demarcation;
8. establishing four angularly disposed fold lines on said blank, one of said four fold lines connecting said first point with a fifth point on said longitudinal fold line;

a second of said four fold lines connecting said second point with a sixth point on said longitudinal fold line; a third of said four fold lines connecting said third point with said fifth point on said longitudinal fold line;

and the last of said four fold lines connecting said fourth point with said sixth point on said longitudinal fold line, provided, however, that none of said four fold lines meets said longitudinal fold line at that portion of said longitudinal fold line lying between said second transverse line of demarcation and said third transverse line of demarcation, and further provided that the distance between the intersection of said longitudinal fold line with said second transverse line of demarcation and said fifth point does not exceed about 75% of the distance between said first and second transverse lines of demarcation and the distance between the intersection of said longitudinal fold line with said third transverse line of demarcation and said sixth point does not exceed about 75% of the distance between said first and said third transverse lines of demarcation;

9. creasing said blank along said longitudinal fold line;
10. moving said first and second points to positions on said one of said side edges lying between said second and said third transverse lines of demarcation; and
11. moving said third and fourth points to positions on said said of saiid side edges lying between said second and said third transverse lines of demarcation.

2. A method according to claim 1 comprising the step of providing a lightweight, air pervious facing material on a major surface of said filtration medium.

3. A method according to claim 1 comprising the step of providing a lightweight, air pervious facing material on both major surfaces of said filtration medium.

4. A method according to claim 1 in which said blank is trimmed to provide substantially straight side edges after said blank is folded and the folded blank is secured at the sides thereof whereby its generally cup-shaped configuration is retained.

5. A method according to claim 4 further comprising the step of securing binding tapes to the top, bottom, and side edges of the body portion.

6. A method according to claim 5 further comprising the step of providing means for securing said face mask over the mouth and nose of the wearer.

7. A method according to claim 6 wherein said side bindings are extended to provide said means for securing said face mask over the mouth and nose of the wearer.

8. A method according to claim 1 wherein said longitudinal fold line is equidistant from the opposed side edges of said blank.

9. A method according to claim 1 in which said fifth point coincides with the point of intersection of said longitudinal fold line with said second transverse line of demarcation and said sixth point coincides with the point of intersection of said longitudinal fold line with said third transverse line of demarcation.

10. A method according to claim 1 wherein the distance between the intersection of said longitudinal fold line with said second transverse line of demarcation and the point at which said first and third angularly disposed fold lines meet said longitudinal fold line does not exceed about 50% of the distance between said first and said second transverse lines of demarcation and the distance between the intersection of said longitudinal fold line with said third transverse line of demarcation and the point at which said second and fourth angularly disposed fold lines meet said longitudinal fold line does not exceed about 50% of the distance between said first and said third transverse lines of demarcation.

11. A method according to claim 1 wherein the distance between the intersection of said longitudinal fold line with said second transverse line of demarcation and the point at which said first and third angularly disposed fold lines meet said longitudinal fold line does not exceed about 25% of the distance between said first and said second transverse lines of demarcation and the distance between the intersection of said longitudinal fold line with said third transverse line of demarcation and the point at which said second and fourth angularly disposed fold lines meet said longitudinal fold line does not exceed about 25% of the distance between said first and said third transverse lines of demarcation.

12. A generally cup-like face mask comprising a body portion and means for holding the mask in place over the nose and mouth of a wearer, said body portion comprising a filtration medium for filtering bacteria and being folded from a blank of said filtration medium, said blank in its unfolded form having top and bottom edges and a pair of opposed side edges, said blank having established thereon;

1. a longitudinal fold line running from top to bottom thereof;
2. a first transverse line of demarcation, said first line being substantially parallel to the top and bottom edges of said blank and extending from side to side thereof;
3. a second transverse line of demarcation extending from side to side of said blank, said second line being between, and generally parallel to, said first transverse line and one of said top and bottom edges of the blank;
4. a third transverse line of demarcation extending from side to side of said blank, said third line being between, and generally parallel to, said first transverse line and the other of said top and bottom edges of the blank;
5. first and second points on one of said side edges of said blank, said first point being between the point at which said second transverse line of demarcation meets said one of said side edges and said one of said top and bottom edges, said second point being between the point at which said third transverse line of demarcation meets said one of said side edges and said other of said top and bottom edges, the distance between said first point and said second transverse line of demarcation, and the distance between said second point and said third transverse line of demarcation being not greater than the distance between said second line of demarcation and said third line of demarcation;
6. third and fourth points on the other of said side edges of said blank, said third point being between the point at which said second transverse line of demarcation meets said other of said side edges and said one of said top and bottom edges, said fourth point being between the point at which said third transverse line of demarcation meets said other of said side edges and said other of said top and bottom edges, the distance between said third point and said second transverse line of demarcation, and the distance between said fourth point and said third transverse line of demarcation being not greater than the distance between said second line of demarcation and said third line of demarcation;
7. four angularly disposed fold lines, one of said four fold lines connecting said first point with a fifth point on said longitudinal fold line;

a second of said four fold lines connecting said second point with a sixth point on said longitudinal fold line;

a third of said four fold lines connecting said third point with said fifth point on said longitudinal fold line;

and the last of said four fold lines connecting said fourth point with said sixth point on said longitudinal fold line, provided, however, that none of said four fold lines meets said longitudinal fold line at that portion of said longitudinal fold line lying between said second transverse line of demarcation and said third transverse line of demarcation, and further provided that the distance between the intersection of said longitudinal fold line with said second transverse line of demarcation and said fifth point does not exceed about 75% of the distance between said first and second transverse lines of demarcation and the distance between the intersection of said longitudinal fold line with said thrid transverse line of demarcation and said sixth point does not exceed about 75% of the distance between said first and said third transverse lines of demarcation;

said blank being creased along said longitudinal fold line;

said first and second points being located, when said blank is in its folded configuration, on said one of said side edges at positions lying between said second said third transverse lines of demarcation;

and said third and fourth points being located, when said blank is in its folded configuration, at positions on said other of said side edges at positions lying between said second and said third transverse lines of demarcation, said folded blank being secured at the sides thereof whereby its cup-shaped configuration is retained.

13. A face mask according to claim 12 wherein said body portion further comprises a lightweight, air pervious facing material on a major surface of said filtration medium.

14. A face mask according to claim 12 wherein said body portion further comprises a lightweight, air pervious facing material on both major surfaces of said filtration medium.

15. A face mask according to claim 14 wherein said facing material is a nonwoven fabric.

16. A face mask according to claim 12 wherein said blank is trimmed of unneeded material and the folded blank is secured at its sides whereby its generally cup-shaped configuration is retained.

17. A face mask according to claim 16 having bindings secured to the top, bottom, and side edges thereof.

18. A face mask according to claim 17 wherein said means for holding the mask in place over the nose and mouth of the wearer comprise extensions of the side bindings.

19. The face mask of claim 12 wherein said longitudinal fold line is equidistant from the opposed side edges of said blank.

20. A face mask according to claim 12 wherein said first and third angularly disposed fold lines meet said longitudinal fold line at the point of intersection of said longitudinal fold line with said second transverse line of demarcation and said second and fourth angularly disposed fold lines meet said longitudinal fold line at the point of intersection of said longitudinal fold line with said third transverse line of demarcation.

21. A face mask according to claim 12 wherein the distance between the intersection of said longitudinal fold line with said second transverse line of demarcation and the point at which said first and third angularly disposed fold lines meet said longitudinal fold line does not exceed about 50% of the distance between said first and said second transverse lines of demarcation and the distance between the intersection of said longitudinal fold line with said third transverse line of demarcation and the point at which said second and fourth angularly disposed fold lines meet said longitudinal fold line does not exceed about 50% of the distance between said first and said third transverse lines of demarcation.

22. A face mask according to claim 12 wherein the distance between the intersection of said longitudinal fold line with said second transverse line of demarcation and the point at which said first and third angularly disposed fold lines meet said longitudinal fold line does not exceed about 25% of the distance between said first and said second transverse lines of demarcation and the distance between the intersection of said longitudinal fold line with said third transverse line of demarcation and the point at which said second and fourth angularly disposed fold lines meet said longitudinal fold line does not exceed about 25% of the distance between said first and said third transverse lines of demarcation.

* * * * *

UNITED STATES PATENT AND TRADEMARK OFFICE

CERTIFICATE OF CORRECTION

PATENT NO. : 3,971,369

DATED : July 27, 1976

INVENTOR(S) : Gary B. Aspelin and James T. Smith

It is certified that error appears in the above-identified patent and that said Letters Patent are hereby corrected as shown below:

Column 1, line 11 "expecially" should be --especially--.

Column 5, line 45 "52" should be --42--.

Column 7 should read as follows:

The preparation of the blank is completed by establishing four angularly disposed fold or crease lines thereon. Two of these fold lines are established so as to join the two points D and F established on the sides of the blank and outwardly of second line of demarcation 58 with point x previously established on longitudinally extending line 52. The remaining two fold lines are established so as to join the two points E and G established on the sides of the blank and outwardly of third line of demarcation 59 with point y previously establishe on line 52. Thus, in the particular embodiment under discussic fold line $f_1$ joins point F with point x; fold line $f_2$ joins point D with point x; fold line $f_3$ joins point G with point y; and fold line $f_4$ joins point E with point y.

At this stage of the preparation, it will be noticed that blank 32 is symmetrically marked with respect to both longitudinal fold line 52 and first transverse line of demarcation 57.

Referring now to Fig. 8, the first step in the sequence of converting the blank into cup shaped form is to crease the blank along longitudinal fold line 52. The crease is made in the manner indicated by the arrow in Fig. 8. As a result of this creasing, or partial folding, around longitudinal fold line 52, the under surface of portion 55 is brought toward the under surface of portion 54 (see Fig. 9). If the under surface

UNITED STATES PATENT AND TRADEMARK OFFICE

CERTIFICATE OF CORRECTION

PATENT NO. : 3,971,369

DATED : July 27,1976

INVENTOR(S) : Gary B. Aspelin and James T.Smith

It is certified that error appears in the above-identified patent and that said Letters Patent are hereby corrected as shown below:

of portions 54 and 55 were to be brought into face to face contact, fold line $f_2$ would be substantially aligned with, and overlie, fold line $f_1$, and fold line $f_4$ would be substantially aligned with, and overlie, fold line $f_3$.

The next step in the folding sequence involves folding the blank so that points D and E on side edge 46 of the blank are moved to positions between second line of demarcation 58 and third line of demarcation 59. This may be accomplished in two ways. In accordance with the preferred way illustrated in Fig. 10, blank 32 is reverse folded around that portion of line 58 lying between side edge 46 and longitudinal fold line 52 and around that portion of line 59 lying between side edge 46 and line 52. Thus, in making the above-mentioned reverse folds, a portion of the lower surface of the blank is turned toward another portion of its lower surface. Also, as seen in Fig. 10, the moving of points D and E to their new positions involves forward folding the blank around lines $f_2$ and $f_4$. These folds, being forward folds, are characterized in that a portion of the upper surface of the blank is turned toward another portion of the upper surface of the blank.

It will be recognized that, in the embodiment under discussion, the reverse folding around lines 58 and 59 and the forward folding around lines $f_2$ and $f_4$ bring points D and E into contact with the under surface 50 of the blank. After points D and E have been moved, in the manner indicated by the

UNITED STATES PATENT AND TRADEMARK OFFICE

CERTIFICATE OF CORRECTION

PATENT NO. : 3,971,369
DATED : July 27,1976
INVENTOR(S) : Gary B. Aspelin and James T.Smith It is certified that error appears in the above-identified patent and that said Letters Patent are hereby corrected as shown below:

arrows in Fig. 10, to their new positions between lines 58 and 59, the portion of side edge 46 between point D and line 58 contacts that portion of side edge 46 lying between lines 58 and 57; and the portion of side edge 46 between point E and line 59 contacts that portion of side edge 48 between lines 59 and 57. Thus, in this particular embodiment, the above-described folding sequence brings points D and E into abutting relationship at the point where first transverse line 57 intersects side edge 46 (see upper portion of Fig. 11).

After the above steps have been completed, the portion of the blank which has just been folded should be secured, e.g., with a few stitches or with a few drops of

| | |
|---|---|
| Column 8, line 29 | "timming" should be --trimming--. |
| Column 8, line 50 | "counter" should be -- (outer --. |
| Column 9, line 48 | "and" should be --that--. |
| Column 11, line 57 | "2" should be --5--. |
| Column 12, line 58 | "on said said of saiid side edges" should be --on said other of said side edges--. |
| Column 14, line 58 | "thrid" should be --third--. |
| Column 14, line 68 | "second said" should be --second and said--. |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*